US012778326B2

(12) United States Patent
Defever

(10) Patent No.: US 12,778,326 B2
(45) Date of Patent: Nov. 3, 2026

(54) FITTED FLAT SHEETS

(71) Applicant: Derrick Dennis Defever, Plymouth, MI (US)

(72) Inventor: Derrick Dennis Defever, Plymouth, MI (US)

( * ) Notice: Subject to any disclaimer, the term of this patent is extended or adjusted under 35 U.S.C. 154(b) by 0 days.

(21) Appl. No.: 18/988,595

(22) Filed: Dec. 19, 2024

(65) Prior Publication Data

US 2026/0174255 A1 Jun. 25, 2026

(51) Int. Cl.
*A47G 9/04* (2006.01)
*A47G 9/02* (2006.01)

(52) U.S. Cl.
CPC ..... *A47G 9/0246* (2013.01); *A47G 9/04* (2013.01)

(58) Field of Classification Search
CPC ..... A47G 9/0246; A47G 9/04
See application file for complete search history.

(56) References Cited

U.S. PATENT DOCUMENTS

| | | | | |
|---|---|---|---|---|
| 4,672,702 | A * | 6/1987 | Isham | A47G 9/02 5/497 |
| 7,398,570 | B2 * | 7/2008 | Seago | A47G 9/0246 5/497 |
| 8,438,679 | B2 * | 5/2013 | Wootten, Jr. | A47C 31/11 5/497 |
| 9,907,419 | B1 * | 3/2018 | Mun | A47G 9/0246 |
| 11,064,825 | B2 * | 7/2021 | Serafini | A47G 9/02 |
| 12,336,635 | B2 * | 6/2025 | Negus | A47C 27/002 |
| 2013/0042411 | A1 * | 2/2013 | Vitale | A47G 9/0246 112/475.08 |
| 2013/0219617 | A1 * | 8/2013 | Maguire | A47G 9/0246 5/497 |
| 2014/0013510 | A1 * | 1/2014 | Mcaleney | A47G 9/02 5/495 |
| 2014/0101850 | A1 * | 4/2014 | Cuneo | A47G 9/0246 5/497 |
| 2016/0100700 | A1 * | 4/2016 | Dunwood | A47G 9/02 5/496 |
| 2018/0008065 | A1 * | 1/2018 | Mun | D05B 3/12 |
| 2020/0260886 | A1 * | 8/2020 | Chen | A47C 21/022 |
| 2021/0169245 | A1 * | 6/2021 | Billups | A47G 9/0246 |
| 2021/0251405 | A1 * | 8/2021 | Grell | A47C 21/022 |
| 2022/0233004 | A1 * | 7/2022 | Buchanan | A47G 9/0223 |
| 2023/0013670 | A1 * | 1/2023 | Pfister | A47G 9/0238 |
| 2025/0151933 | A1 * | 5/2025 | Johnston | A47G 9/04 |
| 2025/0288134 | A1 * | 9/2025 | Griffin | A47G 9/0238 |

FOREIGN PATENT DOCUMENTS

| | | |
|---|---|---|
| CN | 212765128 U | 3/2021 |
| CN | 213405609 U | 6/2021 |

* cited by examiner

*Primary Examiner* — Aaron R Eastman
(74) *Attorney, Agent, or Firm* — Young Basile Hanlon & MacFarlane, P.C.

(57) ABSTRACT

A flat sheet for a bed has a head end, a foot end, a right edge and a left edge defining a total area. A first area within the total area is made of a first material, and a second area within the total area is made of a second material different from the first material, the second material being a stretch material. The second area has a first portion having an edge that forms part of the right edge of the flat sheet and a second portion having an edge that forms part of the left edge of the flat sheet.

14 Claims, 6 Drawing Sheets

FITTED FLAT SHEETS

TECHNICAL FIELD

This disclosure relates to improved bed sheets, and in particular to sheet sets that allow for movement underneath a flat sheet while maintaining coverage and alignment of the flat sheet across the entire bed.

BACKGROUND

Improvements have been directed to fitted sheets and keeping the fitted sheets snug on the mattress. However, keeping a flat sheet in place remains problematic. For those sleeping with another person, the flat sheet is often pulled to one edge if the bed by someone rolling over. For those with restless legs, the flat sheet often ends up off of the legs. For those that like to keep a foot or leg out of the flat sheet for temperature control, the flat sheet is necessarily untucked and can get tangled when rolling over. When the flat sheet comes untucked around most of or the entire bed, it is more time consuming to make the bed. When a bed is against a wall, retucking the flat sheet under the mattress on the wall side is difficult.

SUMMARY

Disclosed herein are implementations of a flat sheet and a sheet set having a flat and fitted sheet having the structures as disclosed herein.

A flat sheet for a bed has a head end, a foot end, a right edge and a left edge defining a total area. A first area within the total area is made of a first material, and a second area within the total area is made of a second material different from the first material, the second material being a stretch material. The second area has a first portion having an edge that forms part of the right edge of the flat sheet and a second portion having an edge that forms part of the left edge of the flat sheet.

The second area may further have a first fastener attached along the right edge of the flat sheet and a second fastener attached along the left edge of the flat sheet, wherein the first fastener and second fastener are configured to fasten the flat sheet to a fitted sheet.

The right edge has a right total length and the left edge has a left total length. The first portion of the second area and the second portion of the second area may have a length that is shorter than the right total length and the left total length, respectively.

The second area may further have a third portion having an edge that forms part of the foot end of the flat sheet.

The second area may further have a third fastener attached along the foot end of the flat sheet, wherein the third fastener is configured to fasten the flat sheet to a fitted sheet.

The foot end of the flat sheet has a total length and the third portion of the second area may have a length shorter than the total length of the foot end.

A first corner defined between the right edge and the foot end and a second corner defined between the left edge and the foot end are part of the first area.

Another implementation is a sheet set for a bed having a flat sheet and a fitted sheet. The flat sheet has a head end, a foot end, a right edge and a left edge defining a total area. The flat sheet has a first area within the total area made of a first material and a second area within the total area made of a second material different from the first material, the second material being a stretch material. A first flat sheet fastener member is attached at an edge of the second area. The fitted sheet has a first fitted sheet fastener member configured to work with the first flat sheet fastener member to fasten the flat sheet to the fitted sheet.

The first fitted sheet fastener member may be positioned adjacent an edge of the fitted sheet.

The first area of the total area of the flat sheet may be larger than the second area.

The second area of the flat sheet may have a first portion that forms part of the right edge of the flat sheet and a second portion that forms part of the left edge of the flat sheet.

The first flat sheet fastener member may be attached along the right edge of the flat sheet. The sheet set may further have a second flat sheet fastener member attached to the second portion of the second area along the left edge of the flat sheet and a second fitted sheet fastener member configured to work with the second flat sheet fastener member to fasten the flat sheet to the fitted sheet.

The second area of the flat sheet may further have a third portion that forms part of the foot end of the flat sheet.

The sheet set may further have a third flat sheet fastener member attached to the third portion of the second area and attached along the foot end of the flat sheet and a third fitted sheet fastener member configured to work with the third flat sheet fastener member to fasten the flat sheet to the fitted sheet.

The first fitted sheet fastener member, the second fitted sheet fastener member and the third fitted sheet fastener member may each be adjacent to a different edge portion of the fitted sheet.

Another implementation of a sheet set for a bed has a flat sheet and a fitted sheet. The flat sheet has a flat head end, a flat foot end, a flat right edge, a flat left edge, and a flat mattress-facing surface, and the fitted sheet has a fitted head end, a fitted foot end, a fitted right edge, a fitted left edge, and a fitted mattress-facing surface. A first connector is attached to the fitted sheet adjacent the fitted right edge opposite the fitted mattress-facing surface and attached to the flat sheet at a location spaced apart from the flat right edge and to the flat mattress-facing surface. A second connector is attached to the fitted sheet adjacent the fitted left edge opposite the fitted mattress-facing surface and attached to the flat sheet at a location spaced apart from the flat left edge and to the flat mattress-facing surface.

The flat sheet and the fitted sheet may be a first material and the first connector and the second connector may be a second material different from the first material, the second material being a stretch material.

The first connector may be between 12 inches and 36 inches wide and attached to the flat sheet such that a flat sheet end of the first connector is parallel to the flat right edge. The second connector may be between 12 inches and 36 inches wide and attached to the flat sheet such that a flat sheet end of the second connector is parallel to the flat left edge.

A third connector may be attached to the fitted sheet adjacent the fitted foot end opposite the fitted mattress-facing surface and attached to the flat sheet at a location spaced apart from the flat foot end and to the flat mattress-facing surface.

The first connector and the second connector may be fixedly attached to both the flat sheet and the fitted sheet.

The first connector and the second connector may be both removably attached to one or both of the flat sheet and the fitted sheet.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Disclosed herein are implementations of a flat sheet and a sheet set for any sized bed. The flat sheet and sheet sets are designed to allow unrestrained movement when the flat sheet is tucked in or attached to the flat sheet, as well as allow access to free a foot or leg from the flat sheet while the flat sheet remains tucked in or attached to the flat sheet.

The disclosed flat sheet and sheet sets may eliminate fighting for the sheet when sharing the bed with another. When the other person rolls away and pulls the sheet with them, the flat sheet and sheet sets fights back, keeping the flat sheet in position and preventing the flat sheet from being pulled off center of the bed. The disclosed flat sheet and sheet sets may prevent chasing the sheet in the night. For those who have active legs while sleeping, the typical flat sheet ends up in a ball at the foot of the bed in the night. The disclosed flat sheet and sheet sets retain the flat sheet above the knee or waist so there is no need to look for it in the middle of the night. The corners are left unattached so hot sleepers can still let their foot out for some air in the night. Making the bed has never been easier due to the disclosed implementations. In the morning there is no need to try to center the flat sheet as it remains centered through the night. In an implementation, the attachment to the fitted sheet keeps the flat sheet looking tucked in at all times. The only necessary tucking is in the corners if a foot has opted to go uncovered for temperature control. The areas of stretch material give the feeling of being hugged in bed without feeling trapped and claustrophobic in tight tucked sheets. Beds that are against a wall or a bunk bed can now be made easily as the flat sheet remains tucked in on the side between the wall and the bed.

Figure 1:
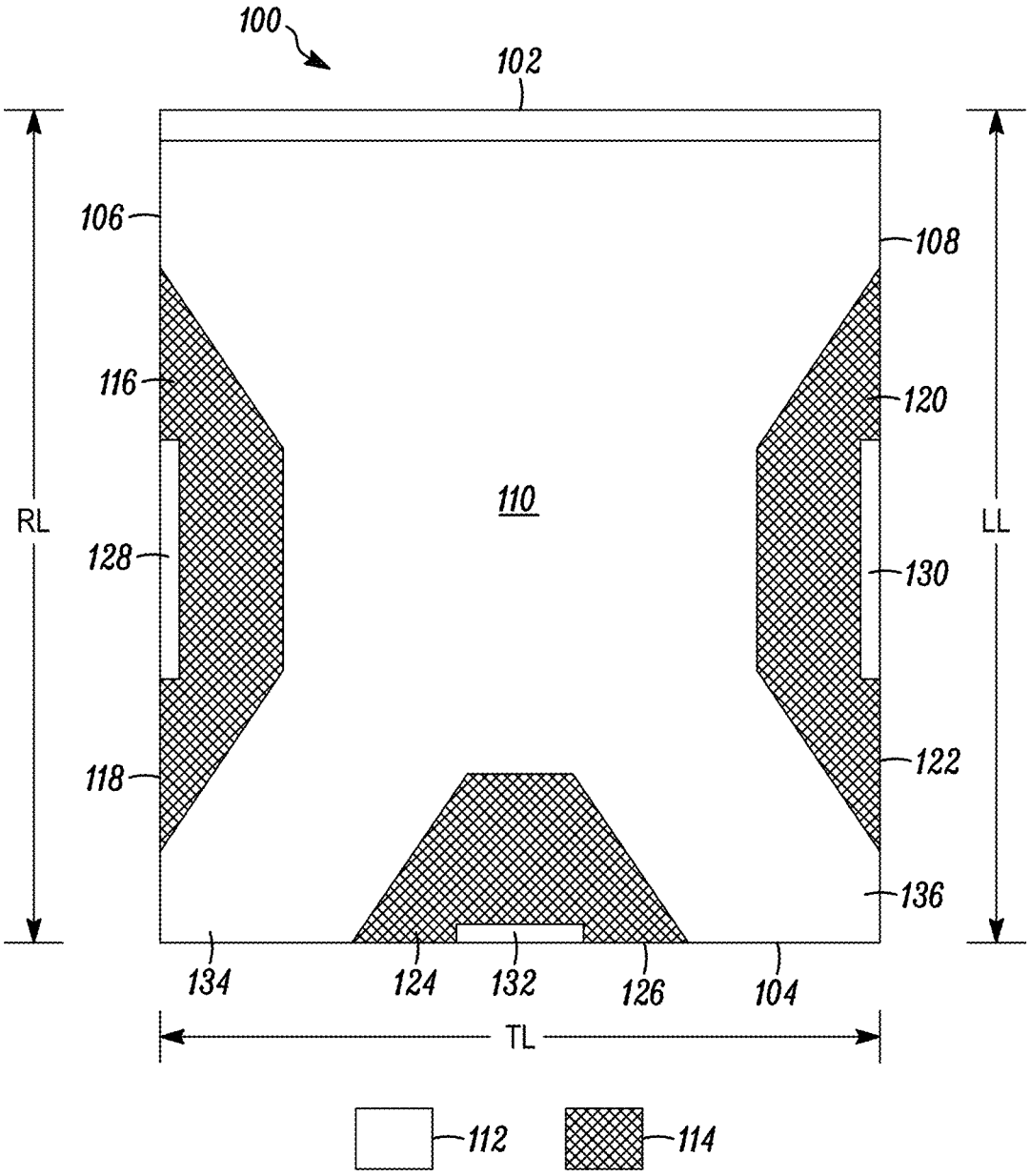
FIG. 1 is a plan view of a flat sheet as disclosed herein.

FIG. 1 illustrates a flat sheet 100 for a bed having a head end 102, a foot end 104, a right edge 106 and a left edge 108 defining a total area 110 (i.e., rectangle). The flat sheet 100 is illustrated with the mattress-facing side in plan view. A first area 112 within the total area 110 is made of a first material, and a second area 114 within the total area 110 is made of a second material different from the first material, the second material being a stretch material. The first area 112 is larger than the second area 114. The first material can be any standard sheet fabric, such as, but not limited to, cotton, bamboo, jersey, satin, sateen, silk, polyester, linen, flannel, and Tencel™. The second material is a stretch material such as, but not limited to, fabrics that contain elastic fibers like spandex, elastane or Lycra, or are knit using a looping production method. In a non-limiting example, the stretch material is stretchable up to two times its original size. The first material of the first area 112 and the second material of the second area 114 are sewn together along seams. The seams may be covered with a material if desired for aesthetics or comfort.

The second area 114 of the total area 110 of the flat sheet 100 has a first portion 116 having an edge 118 that forms part of the right edge 106 of the flat sheet 100 and a second portion 120 having an edge 122 that forms part of the left edge 108 of the flat sheet 100. When tucked in, the flat sheet 100 provides coverage while allowing for movement without feeling overly restrained. The second area 114 may also include a third portion 124 having an edge 126 that forms part of the foot end 104 of the flat sheet 100. This again allows for movement when the sheet is tucked in, providing coverage without feeling overly restricted.

The first portion 116, second portion 120, and third portion 124 are illustrated as trapezoidal, with the outer edge being longer than the inner edge. However, this is not meant to be limiting. Other shapes such as rectangular and square are other non-limiting examples. The first portion 116 and second portion 120 may be of the same size and shape or may differ. The first portion 116, second portion 120, and third portion 124 may extend the same distance from the outer edge or may differ. As non-limiting examples, the first portion and second portion may be about 14 inches in depth from the outer edge while the third portion 124 may be about 18 inches in depth from the foot end.

The flat sheet 100 may further have one or more of a first fastener 128 attached along the right edge 106 of the flat sheet 100, a second fastener 130 attached along the left edge 108 of the flat sheet 100, and a third fastener 132 attached along the foot end 104 of the flat sheet 100. The first fastener 128, second fastener 130, and third fastener 132 are configured to fasten the flat sheet 100 to a fitted sheet.

The right edge 106 of the flat sheet 100 has a right total length RL and the left edge 108 has a left total length LL. The first portion 116 of the second area 114 and the second portion 120 of the second area 114 each have lengths that are shorter than the right total length RL and the left total length LL, respectively, as illustrated in FIG. 1. In other words, the length of the first portion 116 is less than the length of the right edge 106 and the length of the second portion 120 is less than the length of the left edge 108 of the flat sheet 100. As a non-limiting example, the first portion 116 and second portion 120 may have a length of between about 30 inches to 70 inches while the right total length RL and left total length LL may be about 100 inches. The foot end 104 of the flat sheet 100 has a total length TL (i.e., the width of the flat sheet) and the third portion 124 of the second area 114 may have a shorter length than the total length TL of the foot end 104.

A first corner 134 defined between the right edge 106 and the foot end 104 and a second corner 136 defined between the left edge 108 and the foot end 104 are part of the first area 112. This allows for a person to stick a foot or leg portion outside of the flat sheet 100 for temperature control or other reasons.

Figure 2:
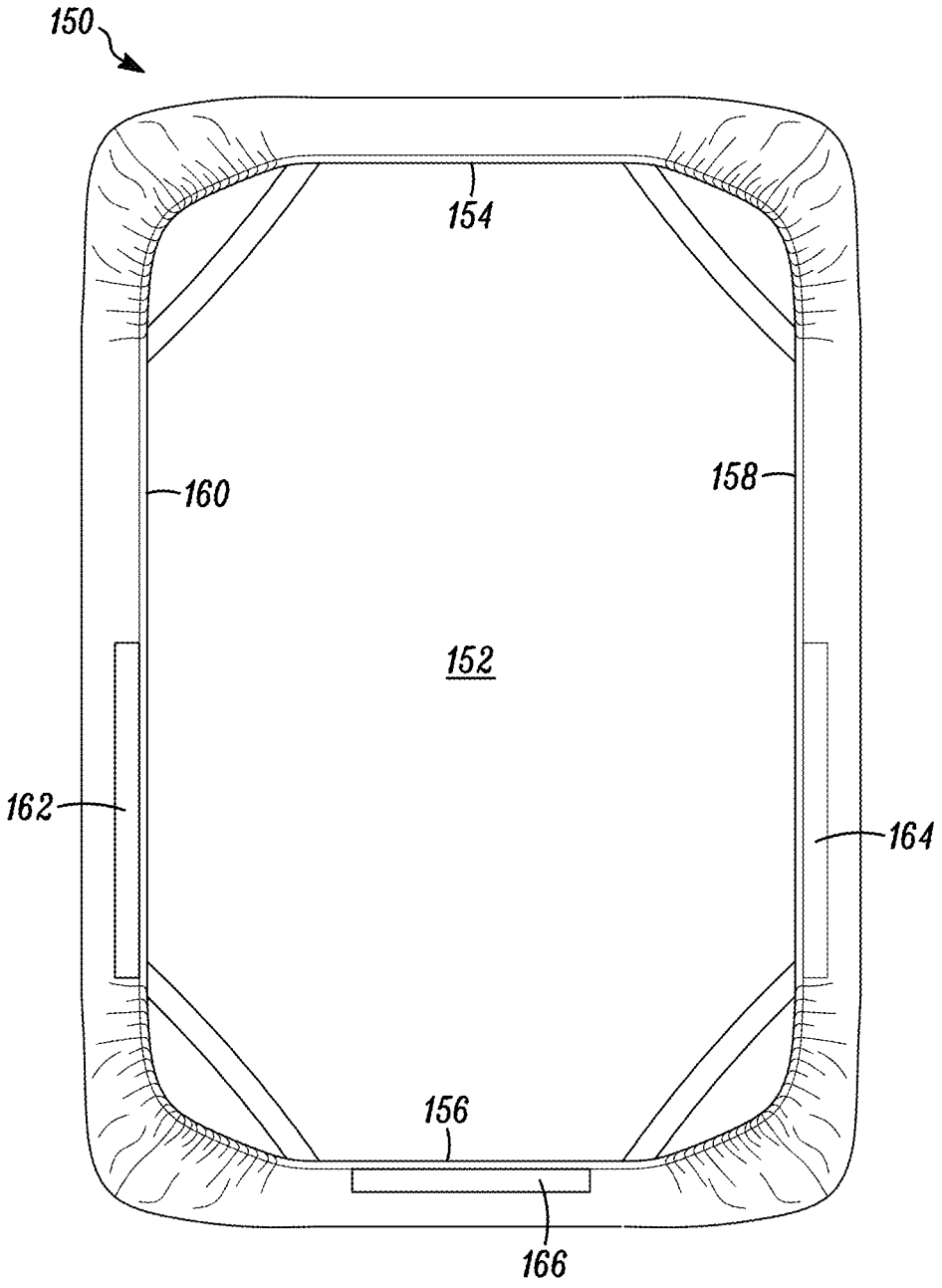
FIG. 2 is a plan view of a fitted sheet on a mattress viewed from the bottom of the mattress.

A sheet set for a bed using the flat sheet 100 described with respect with FIG. 1 includes a fitted sheet 150, shown in FIG. 2 on a mattress 152 and viewed from a bottom side of the mattress. The fitted sheet has a head end 154, a foot end 156, a right edge 158 and a left edge 160. The fitted sheet 150 is a conventional fitted sheet with elastic around the head end 154, foot end 156, right edge 158 and left edge 160 to keep the fitted sheet 150 tightly around the mattress 152. The fitted sheet 150 may also include corner elastic to better hold the flat sheet onto the mattress.

As noted with respect to FIG. 1, the flat sheet 100 may have one or more of a first fastener 128 which is a first flat sheet fastener member, a second fastener 130 which is a second flat sheet fastener member, and a third fastener 132 which is a third flat sheet fastener member. The fitted sheet 150 will respectively have one or more of a first fitted sheet fastener member 162, a second fitted sheet fastener member 164, and a third fitted sheet fastener member 166, configured to work with the first flat sheet fastener member to fasten the flat sheet to the fitted sheet. The first fitted sheet fastener member 162 is positioned adjacent the right edge 160 of the fitted sheet 150 and is configured to work with the first flat sheet fastener member (first fastener 128) to fasten the flat sheet 100 to the fitted sheet 150. The second fitted sheet fastener member 164 is positioned adjacent the left edge 158 of the fitted sheet 150 and is configured to work with the second flat sheet fastener member (second fastener 130) to fasten the flat sheet 100 to the fitted sheet 150. The third fitted sheet fastener member 166 is positioned adjacent the foot end 156 of the fitted sheet 150 and is configured to work with the third flat sheet fastener member (third fastener 132) to fasten the flat sheet 100 to the fitted sheet 150.

The fasteners used herein may be such that the flat sheet is fixedly attached to the fitted sheet. Examples of such a fastener would be stitching and other means of fastening intended to be permanent. The fasteners used herein may be such that the flat sheet is removably attached to the fitted sheet so that they may be separated for washing, storing, etc. Examples of such a fastener include one-way zippers, two-way zippers, hook and loop fasteners, snaps, buttons, and any other means of fastening intended to be detachable. Any combination of fixed and detachable fasteners may be used. The first fastener 128, second fastener 130, and third fastener 132 may extend the same lengths or different lengths. A non-limiting length of the fasteners is 24 inches.

Figure 3:
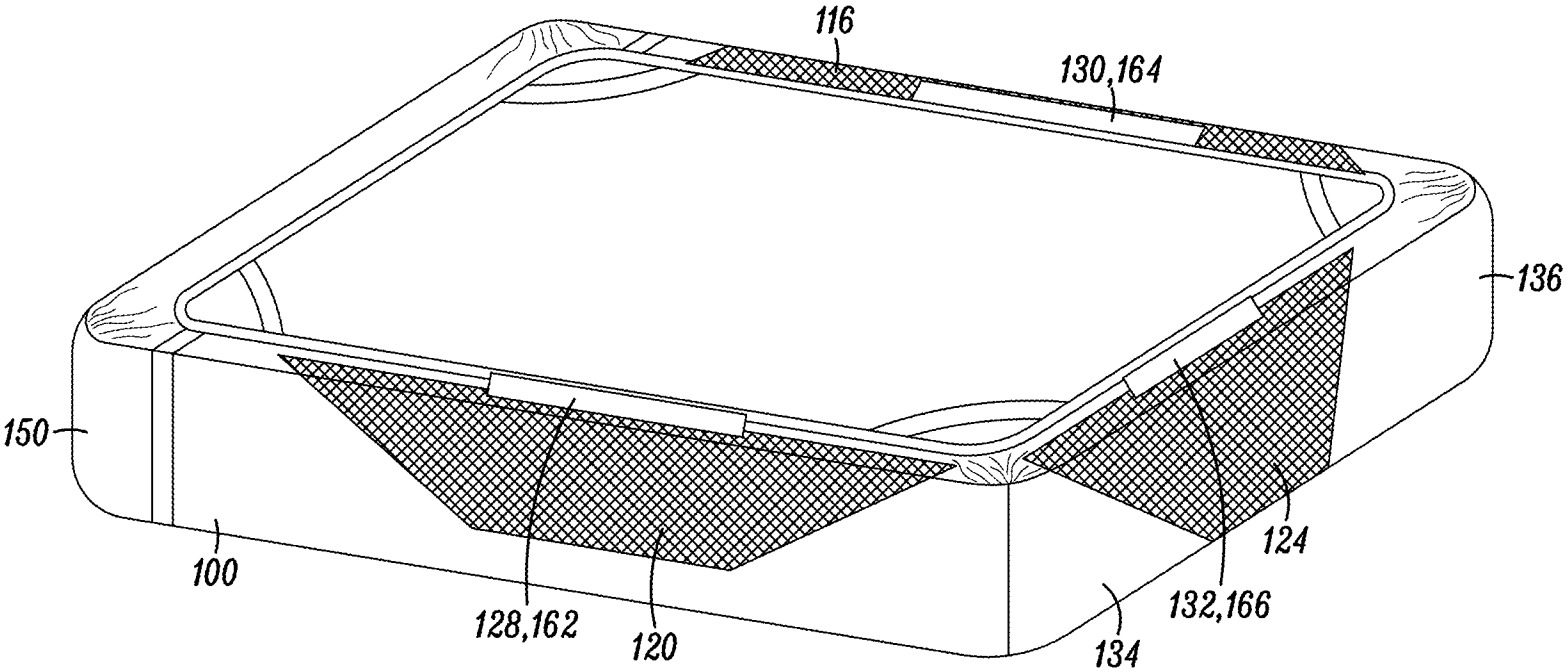
FIG. 3 is a perspective view of a sheet set as disclosed herein on a mattress and viewed from the bottom of the mattress.
Figure 4:
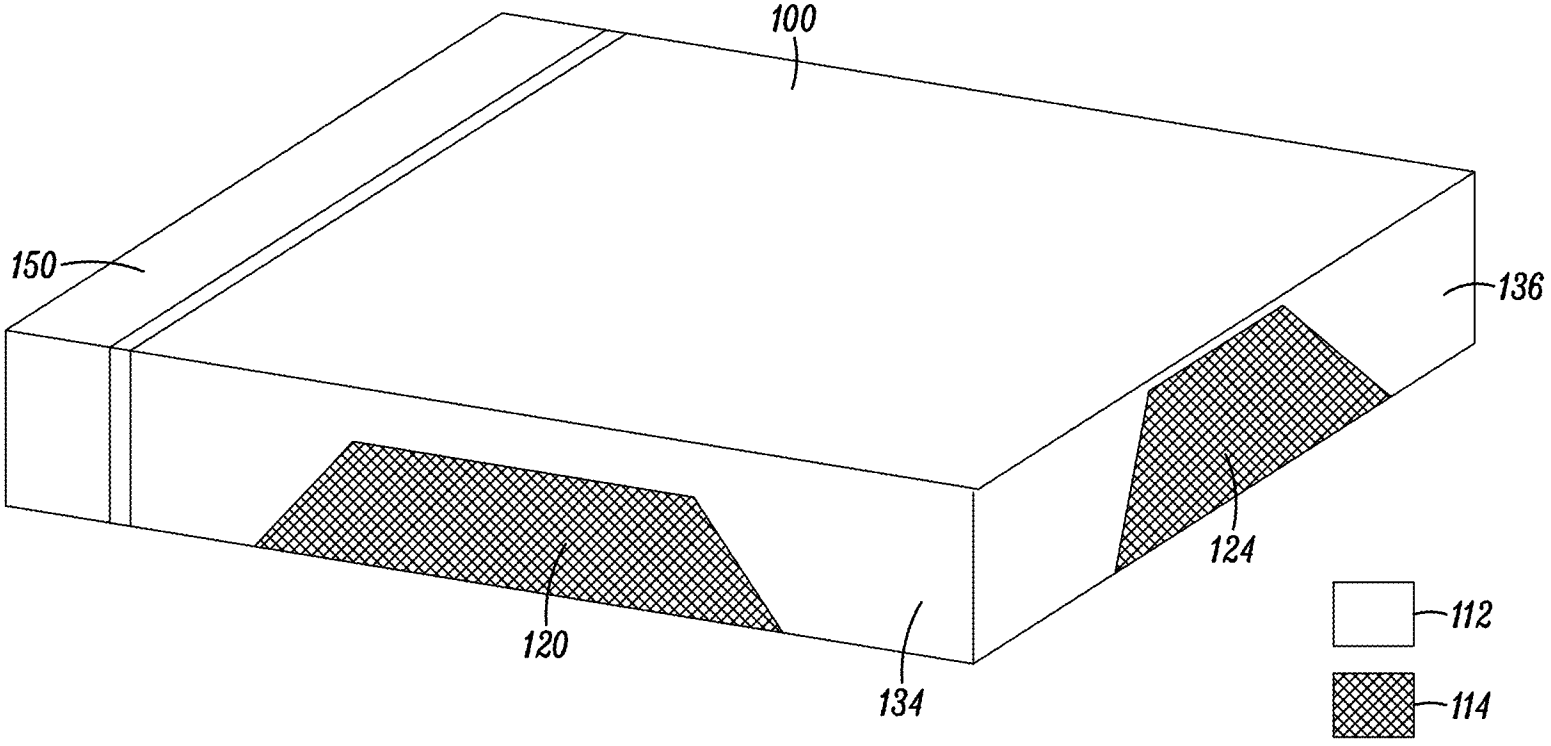
FIG. 4 is a perspective view of the sheet set of FIG. 3 viewed from the top of the mattress.

FIG. 3 illustrates the flat sheet 100 attached to the fitted sheet 150 when viewed from the bottom of the mattress 152. FIG. 4 illustrates the flat sheet 100 attached to the fitted sheet 150 viewed from the top of the mattress 152.

Figure 5A:
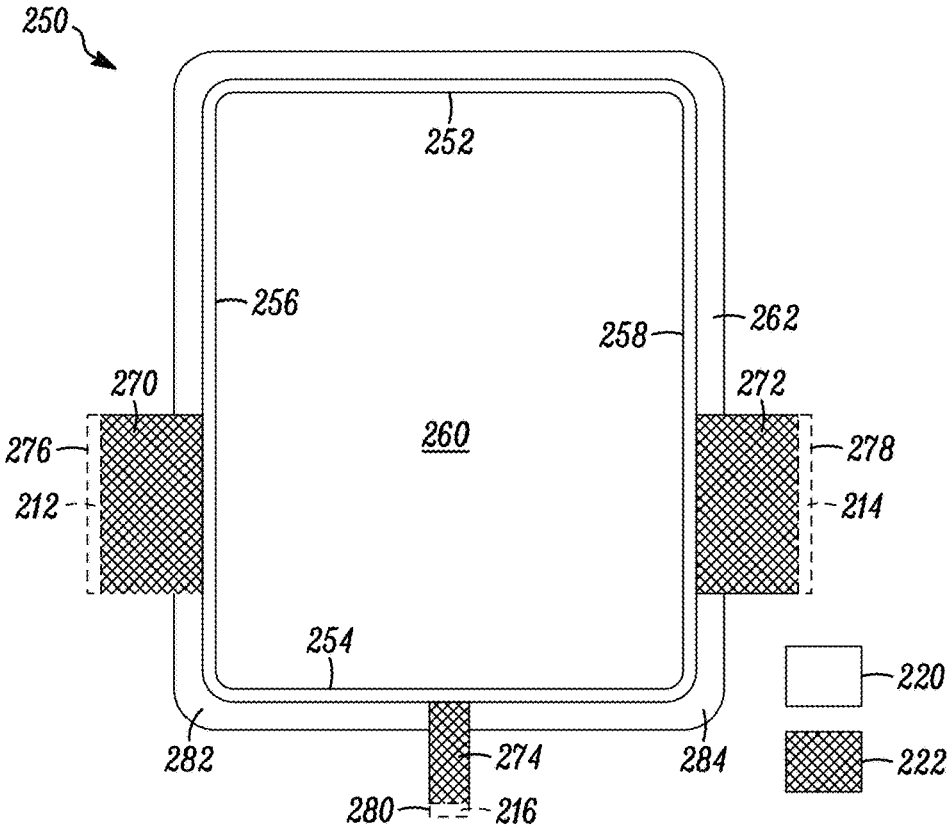
FIGS. 5A-5C illustrate another implementation of a sheet set as disclosed herein.
Figure 5B:
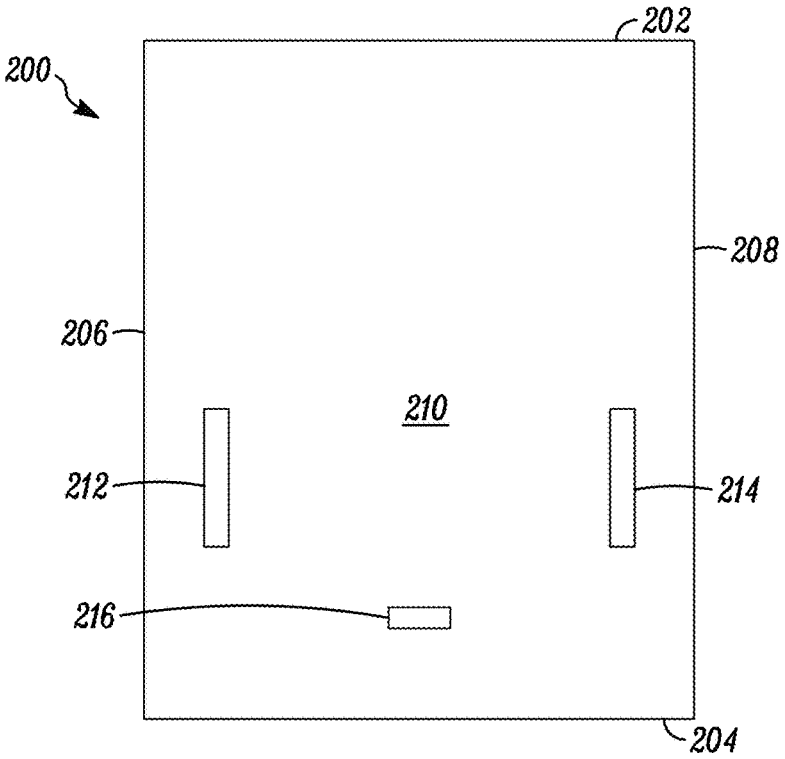
Figure 5C:
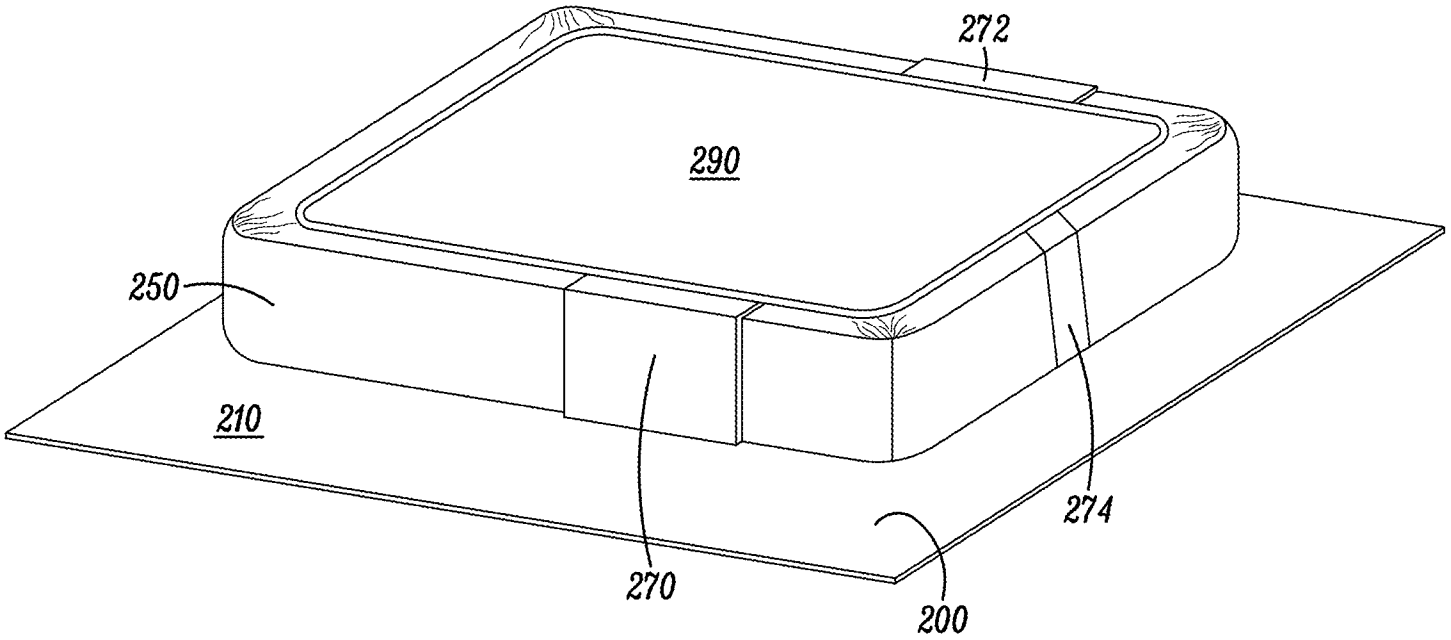

Another implementation of a sheet set is illustrated in FIGS. 5A-5C. The flat sheet 200 has a flat head end 202, a flat foot end 204, a flat right edge 206, a flat left edge 208, and a flat mattress-facing surface 210, and the fitted sheet 250 has a fitted head end 252, a fitted foot end 254, a fitted right edge 256, a fitted left edge 258, and a fitted mattress-facing surface 260, so that the perimeter 262 of the fitted sheet 250 faces away from the mattress. A first connector 270 is attached to the fitted sheet 250 adjacent the fitted right edge 256 opposite the fitted mattress-facing surface 260 and attached to the flat sheet 200 at a location 212 spaced apart from the flat right edge 206 and to the flat mattress-facing surface 210. A second connector 272 is attached to the fitted sheet 250 adjacent the fitted left edge 258 opposite the fitted mattress-facing surface 260 and attached to the flat sheet 200 at a location 214 spaced apart from the flat left edge 208 and to the flat mattress-facing surface 210. A third connector 274 may be attached to the fitted sheet 250 adjacent the fitted foot end 254 opposite the fitted mattress-facing surface 260 and attached to the flat sheet 200 at a location 216 spaced apart from the flat foot end 204 and to the flat mattress-facing surface 210.

The flat sheet 200 and the fitted sheet 250 may be a first material 220 and the first connector 270, the second connector 272, and the third connector 274 may be a second material 222 different from the first material, the second material being a stretch material. The first material can be any standard sheet fabric, such as, but not limited to, cotton, bamboo, jersey, satin, sateen, silk, polyester, linen, flannel, and Tencel™. The second material is a stretch material such as, but not limited to, fabrics that contain elastic fibers like spandex, elastane or Lycra, or are knit using a looping production method. In a non-limiting example, the stretch material is stretchable up to two times its original size. The second material 222 and first material 220 are attached along each end of the connectors.

The first connector 270 may be between 12 inches and 36 inches wide and attached to the flat sheet 200 such that a flat sheet end 276 of the first connector 270 is substantially parallel to the flat right edge 206. The second connector 272 may be between 12 inches and 36 inches wide and attached to the flat sheet 200 such that a flat sheet end 278 of the second connector 272 is substantially parallel to the flat left edge 208. The third connector 274 may be between about 2 inches and 12 inches wide and attached to the flat sheet 200 such that a flat sheet end 280 of the third connector 274 is substantially parallel to the flat foot end 204. FIG. 5C illustrates the mattress 290 upside down showing the first connector 270, the second connector 272, and the third connector 274 connected to both the flat sheet 200 and the fitted sheet 250.

The first connector 270 and the second connector 272 are positioned along the right side and left side, respectively, to allow for room in the open right bottom corner 282 and left bottom corner 284 so that a person can still a foot or part of a leg out of the sheets as desired for temperature regulation or comfort. To allow for ease of getting into and out of bed, the first connector 270 and second connector 272 can be positioned in toward the foot end of the bed providing for the open right bottom corner 282 and left bottom corner 284.

The first connector 270, the second connector 272, and the third connector 274 may be fixedly attached to both the flat sheet 200 and the fitted sheet 250, such as by sewing them together. Alternatively, the first connector 270, the second connector 272, and the third connector 274 may be removably attached to one or both of the flat sheet 200 and the fitted sheet 250. For example, the first connector 270, the second connector 272, and the third connector 274 may be fixedly attached to the flat sheet 200 and removably attached to the fitted sheet 250 to allow for easier washing.

Also disclosed herein are other means of maintaining a flat sheet onto a mattress. An elastic strap or piece of stretch material may attach to the flat sheet at a location spaced apart from a right edge of the flat sheet on either a mattress-facing side or a non-mattress-facing side. Its other end is attached to the fitted sheet at a location along the right edge of the fitted sheet so that the attachment is under the mattress in use. Another elastic strap or piece of stretch material may attach to the flat sheet at a location spaced apart from a left edge of the flat sheet on either a mattress-facing side or a non-mattress-facing side. Its other end is attached to the fitted sheet at a location along the left edge of the fitted sheet so that the attachment is under the mattress in use. The location of the elastic strap or piece of stretch material is along the lower half (foot end) of the flat sheet. Yet another elastic strap or piece of stretch material may attach to the flat sheet at a location spaced apart from a foot end of the flat sheet on either a mattress-facing side or a non-mattress-facing side. Its other end is attached to the fitted sheet at a location along the foot end of the fitted sheet so that the attachment is under the mattress in use. More than one elastic strap or piece of stretch material may be used per side. The attachments may be done with any type of fastener, either fixedly or removably. The elastic strap or piece of stretch material does not need to be elastic or have stretch if the strap or material is used in conjunction with the flat sheet 100 as disclosed herein.

Also disclosed herein is the use of one or more elastic straps or pieces of stretch material that is attached at one end to the flat sheet at a location spaced apart from a right edge or on the right edge of the flat sheet on either a mattress-facing side or a non-mattress-facing side. The other end is attached to the flat sheet at a location spaced apart from a left edge of the flat sheet or at the left edge on either a mattress-facing side or a non-mattress-facing side. The one or more elastic straps or pieces of stretch material are configured to go underneath the mattress to hold the flat sheet onto the mattress. The location of the one or more elastic straps or pieces of stretch material is along the lower half (foot end) of the flat sheet.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A sheet set for a bed, comprising:

a flat sheet that is a rectangle having a first width, a head end, a foot end, a right edge and a left edge, the flat sheet comprising:

a first area within the rectangle made of a first material;

a second area within the rectangle having a second width shorter than the first width and made of a second material different from the first material, the second material being a stretch material, the first area and the second area together forming the rectangle; and a first flat sheet fastener member attached at an edge of the second area; and a fitted sheet comprising a first fitted sheet fastener member configured to work with the first flat sheet fastener member to fasten the flat sheet to the fitted sheet.

2. The sheet set for the bed of claim 1, wherein the first fitted sheet fastener member is positioned adjacent an edge of the fitted sheet.

3. The sheet set for the bed of claim 1, wherein the first area is larger than the second area.

4. The sheet set for the bed of claim 1, wherein the second area of the flat sheet has a first portion that extends into the rectangle along a part of the right edge of the flat sheet and a second portion that extends into the rectangle along a part of the left edge of the flat sheet.

5. The sheet set for the bed of claim 4, wherein the first flat sheet fastener member is attached along the right edge of the flat sheet, the sheet set further comprising:

a second flat sheet fastener member attached to the second portion of the second area along the left edge of the flat sheet; and a second fitted sheet fastener member configured to work with the second flat sheet fastener member to fasten the flat sheet to the fitted sheet.

6. The sheet set for the bed of claim 5, wherein the second area of the flat sheet further has a third portion that extends into the rectangle along a part of the foot end of the flat sheet.

7. The sheet set for the bed of claim 6, further comprising:

a third flat sheet fastener member attached to the third portion of the second area along the foot end of the flat sheet; and a third fitted sheet fastener member configured to work with the third flat sheet fastener member to fasten the flat sheet to the fitted sheet.

8. The sheet set for the bed of claim 1, wherein a first corner defined between the right edge and the foot end and a second corner defined between the left edge and the foot end are part of the first area.

9. A flat sheet for a bed, the flat sheet comprising:

a head end, a foot end, a right edge and a left edge defining a rectangle;

a first area within the rectangle made of a first material; and a second area within the rectangle made of a second material different from the first material, the second material being a stretch material, wherein the second area comprises:

a first portion having an edge that forms a part of the right edge that is less than a length of the right edge of the flat sheet; and a second portion having an edge that forms a part of the left edge that is less than a length of the left edge of the flat sheet, wherein a first corner defined between the right edge and the foot end and a second corner defined between the left edge and the foot end are part of the first area.

10. The flat sheet of claim 9, wherein the second area further comprises:

a first fastener attached along the right edge of the flat sheet; and a second fastener attached along the left edge of the flat sheet, wherein the first fastener and second fastener are configured to fasten the flat sheet to a fitted sheet.

11. The flat sheet of claim 9, wherein the second area further comprises a third portion having an edge that forms part of the foot end of the flat sheet.

12. The flat sheet of claim 11, wherein the second area further comprises a third fastener attached along the foot end of the flat sheet, wherein the third fastener is configured to fasten the flat sheet to a fitted sheet.

13. The flat sheet of claim 11, wherein the foot end has a total length and the third portion of the second area has a length shorter than the total length of the foot end.

14. A flat sheet for a bed, the flat sheet comprising:

a head end, a foot end, a right edge and a left edge defining a rectangle;

a first area within the rectangle made of a first material; and a second area within the rectangle made of a second material different from the first material, the second material being a stretch material, wherein the second area comprises:

a first portion having an edge that forms a part of the right edge that is less than a length of the right edge of the flat sheet;

a second portion having an edge that forms a part of the left edge that is less than a length of the left edge of the flat sheet; and a third portion having an edge that forms part of the foot end that is less than a width of the flat sheet.

* * * * *